US007501160B2

(12) United States Patent
Noro et al.

(10) Patent No.: US 7,501,160 B2
(45) Date of Patent: Mar. 10, 2009

(54) APPARATUS FOR COATING OUTER PERIPHERAL SURFACE OF PILLAR STRUCTURE AND METHOD FOR COATING OUTER PERIPHERAL SURFACE OF PILLAR STRUCTURE

(75) Inventors: Takashi Noro, Nagoya (JP); Takahisa Kaneko, Nagoya (JP)

(73) Assignee: NGK Insulators, Ltd., Nagoya (JP)

( * ) Notice: Subject to any disclaimer, the term of this patent is extended or adjusted under 35 U.S.C. 154(b) by 249 days.

(21) Appl. No.: 10/531,575

(22) PCT Filed: Oct. 21, 2003

(86) PCT No.: PCT/JP03/13430

§ 371 (c)(1),
(2), (4) Date: Apr. 18, 2005

(87) PCT Pub. No.: WO2004/037440

PCT Pub. Date: May 6, 2004

(65) Prior Publication Data

US 2006/0102070 A1 May 18, 2006

(30) Foreign Application Priority Data

Oct. 22, 2002 (JP) ..... 2002-306709

(51) Int. Cl.
*B05D 1/02* (2006.01)

(52) U.S. Cl. ..... 427/425; 427/356; 427/427.3

(58) Field of Classification Search ..... 118/DIG. 11, 118/416, 320, 321, 304, 206, 107; 427/356, 427/425, 427.3
See application file for complete search history.

(56) References Cited

U.S. PATENT DOCUMENTS

| | | | | | |
|---|---|---|---|---|---|
| 1,281,407 | A | * | 10/1918 | Marquess | 118/321 |
| 3,691,992 | A | * | 9/1972 | Beemer | 118/107 |
| 4,397,893 | A | * | 8/1983 | Bottoms | 427/455 |
| 4,809,640 | A | * | 3/1989 | Pilley et al. | 118/257 |
| 5,435,847 | A | * | 7/1995 | Shibata et al. | 118/410 |
| 5,749,970 | A | | 5/1998 | Fukuta et al. | |

FOREIGN PATENT DOCUMENTS

| | | |
|---|---|---|
| JP | A 58-210873 | 12/1983 |
| JP | A 4-64768 | 2/1992 |
| JP | A 8-323727 | 12/1996 |

* cited by examiner

*Primary Examiner*—Brenda A Lamb
(74) *Attorney, Agent, or Firm*—Oliff & Berridge, PLC

(57) ABSTRACT

An apparatus for coating an outer peripheral surface of a pillar structure 1 comprising a smoothing means, and a nozzle 12*b* having an opening 12*c* for supplying a coating material; the opening 12*c* being disposed nearly at the same position as that of the upper end portion 1*e* of the structure 1 in nearly vertical direction of the structure when being held for coating, and having a length of the longer direction shorter than the length between the both ends of the structure 1. The coating material is supplied from a nozzle 12*b* to the outer peripheral surface 1*a* of the structure and coating it on the outer peripheral surface 1*a* while smoothing the coating surface by a smoothing means 10. The coated surface of the structure is protected from cracking during drying after coating and it is free from defects. A coating method using the apparatus is also provided.

13 Claims, 6 Drawing Sheets

APPARATUS FOR COATING OUTER PERIPHERAL SURFACE OF PILLAR STRUCTURE AND METHOD FOR COATING OUTER PERIPHERAL SURFACE OF PILLAR STRUCTURE

TECHNICAL FIELD

The present invention relates to an apparatus for coating the outer peripheral surface of a pillar structure and a method for coating the outer peripheral surface of a pillar structure. More particularly, it relates an apparatus for coating the outer peripheral surface of a pillar structure and a method for coating the outer peripheral surface of a pillar structure according to which a coating on the outer peripheral surface free from defects can be formed by inhibiting occurrence of cracking during drying after coating of the outer peripheral surface of a pillar structure.

BACKGROUND ART

Hitherto, coating of outer peripheral surface of a pillar structure of which the outer peripheral surface is curved surface, such as cylindrical columnar body or elliptic columnar body, has usually been carried out by hand labor, which is not efficient. Thus, the inventors proposed an apparatus for coating the outer peripheral surface of a ceramic honeycomb structure (a pillar structure) (JP-A-4-64768). According to this apparatus, the outer peripheral surface of a ceramic honeycomb structure of which the outer peripheral portions have been previously removed by working is coated with a slurry to form an outer wall part, and thus a product having a sufficient strength can be obtained even from such a honeycomb fired body as having deformed cells on the peripheral part (outer peripheral surface). However, in the case of this apparatus for coating the outer peripheral surface, there are caused omission of coating at both end portions of the outer peripheral surface, difficulty in removal of the product after coating and contamination of the apparatus with coating materials, resulting in problems in both the quality and the operability.

Furthermore, the inventors proposed an apparatus for coating the outer peripheral surface of a columnar body (pillar structure) (JP-A-8-323727). This apparatus is characterized by being provided with a first pallet holding the columnar body, a mechanism rotating on the central axis of the first pallet and a smoothing plate provided with a given clearance from the outer periphery of the columnar body. According to this apparatus, a coating material is supplied from a nozzle (supplying and coating means) and coated on a rotating columnar body disposed on the first pallet and is smoothed by the smoothing plate, and thus a coated columnar body high in dimensional accuracy can be obtained in a short time as compared with hand-coating. However, this outer peripheral surface coating apparatus suffers from the problems that since the direction of the central axis of the pillar structure is nearly vertical direction and the nozzle is disposed along the whole outer peripheral surface between the both ends (through the whole outer peripheral surface between the upper side and the lower side), the coating material scraped by the smoothing plate flows down (to the lower side of the outer peripheral surface) and stays at the lower part of the nozzle, which deposits on the outer peripheral surface to cause thick coating on the lower part of the outer peripheral surface. Therefore, there is a problem that the coating portion on the lower part of the outer peripheral surface on which the coating becomes too thick is cracked during drying after coating.

DISCLOSURE OF INVENTION

The present invention has been made in view of the above problems, and the object of the present invention is to provide an apparatus for coating the outer peripheral surface of a pillar structure and a method for coating the outer peripheral surface of a pillar structure according to which since a coating material is supplied to and coated on the upper part of the pillar structure the central axis of which is maintained in nearly vertical direction and the coating surface is smoothed between the outer peripheral surface and a smoothing means having a length longer than the length between the both ends of the pillar structure, the coating material is uniformly coated on the outer periphery to inhibit partial thick coating (on the lower part of the outer peripheral surface), and hence the coating portion can be inhibited from cracking during the drying after coating.

For attaining the above object, the present invention provides the following apparatus for coating the outer peripheral surface of a pillar structure and method for coating the outer peripheral surface of a pillar structure.

[1] An apparatus for coating the outer peripheral surface of a pillar structure which is provided with a holding means which holds the pillar structure in nearly vertical direction and rotates together with the held pillar structure on an axis of nearly vertical direction as a common rotating axis, a supplying and coating means which is disposed at a given position with respect to the outer peripheral surface of the pillar structure and supplies a coating material to the outer peripheral surface of the rotating pillar structure and coats the coating material on the outer peripheral surface, and a smoothing means which smoothes the coating surface of the coating material supplied to and coated on the outer peripheral surface, wherein the supplying and coating means has a nozzle having an opening in the form of a slit for supplying the coating material toward the outer peripheral surface and coating the coating material thereon and the opening of the nozzle is disposed in nearly vertical direction with the position of the upper end of the opening being nearly the same as the position of the upper end of the pillar structure and has a length in longer direction which is shorter than the length between the both ends of the pillar structure, and the smoothing means has a length in longer direction which is not shorter than the length between the both ends of the pillar structure and is disposed in nearly vertical direction in such a state as keeping a given distance from the outer peripheral surface or contacting with the outer peripheral surface, and the coating material is supplied from the opening of the nozzle to the upper side of the outer peripheral surface of the pillar structure and coated thereon, and the coating surface of the coating material supplied and coated is smoothed between the outer peripheral surface and the longer side end portion of the smoothing means to form a uniform coating surface on the whole outer peripheral surface of the pillar structure.

[2] An apparatus for coating the outer peripheral surface of a pillar structure described in the above [1], wherein the length of the opening of the nozzle in longer direction is 30-80% of the length between the both ends of the pillar structure.

[3] An apparatus for coating the outer peripheral surface of a pillar structure described in the above [1] or [2], wherein the holding means has a pedestal which holds the pillar structure in the vertical direction placed thereon with one end thereof facing downward.

[4] An apparatus for coating the outer peripheral surface of a pillar structure described in the above [3], wherein the holding means has a cam which presses another end of the pillar structure held on the pedestal downwardly from the upper end and rotates on the axis of the nearly vertical direction as a common rotating axis.

[5] An apparatus for coating the outer peripheral surface of a pillar structure described in the above [4], wherein the outer peripheral shape of the pedestal and that of the cam are nearly the same.

[6] An apparatus for coating the outer peripheral surface of a pillar structure described in any of the above [3]-[5] which is further provided with a centering means which holds the pillar structure and the pedestal and/or the cam in a given positional relation.

[7] An apparatus for coating the outer peripheral surface of a pillar structure described in any one of [3]-[6] which is further provided with a following means which drives the smoothing means following the outer periphery of the pedestal and/or the cam so that the smoothing means is disposed at a given position with respect to the outer peripheral surface of the pillar structure.

[8] An apparatus for coating the outer peripheral surface of a pillar structure described in the above [7], wherein the following means has first and second following rollers which are disposed at a given distance from each other and move backward and forward following the outer periphery of the cam while contacting with the outer periphery of the cam together with the supplying and coating means and the smoothing means, and the first and second following rollers are disposed so that the angle formed by a line passing through the centers of the respective rollers and the smoothing means is a given angle.

[9] An apparatus for coating the outer peripheral surface of a pillar structure described in the above [8], wherein the following means further has third and fourth following rollers which move backward and forward following the outer periphery of the pedestal while contacting with the outer periphery of the pedestal together with the supplying and coating means and the smoothing means, and the rotating axis of the third following roller and that of the first following roller are common and the rotating axis of the fourth following roller and that of the second following roller are common.

[10] An apparatus for coating the outer peripheral surface of a pillar structure described in any one of the above [3]-[9] wherein the outer periphery of the pedestal and/or the cam comprise stainless steel or ceramics.

[11] An apparatus for coating the outer peripheral surface of a pillar structure described in any one of the above [1]-[10] wherein the smoothing means comprises stainless steel or wear-resistant ceramics.

[12] An apparatus for coating the outer peripheral surface of a pillar structure described in any one of the above [1]-[11], wherein the shape of a section of the pillar structure cut along a plane perpendicular to the direction of the central axis of the pillar structure is circular or elliptical.

[13] An apparatus for coating the outer peripheral surface of a pillar structure described in any one of the above [1]-[12], wherein the pillar structure is a honeycomb structure comprising a plurality of cells which are flow paths for fluid.

[14] An apparatus for coating the outer peripheral surface of a pillar structure described in any one of the above [1]-[13], wherein the supplying and coating means and the smoothing means can rotate together along the outer periphery of the pillar structure.

[15] A method for coating the outer peripheral surface of a pillar structure using the apparatus for coating the outer peripheral surface of a pillar structure described in any one of the above [1]-[14] which comprises holding the pillar structure by the holding means, supplying the coating material from the supplying and coating means on the outer peripheral surface of the pillar structure and coating the coating material thereon while rotating the pillar structure and the holding means on the axis of nearly vertical direction as a common rotating axis, and smoothing the coating surface of the supplied and coated coating material between the outer peripheral surface and the longer side end portion of the smoothing means.

BEST MODE FOR CARRYING OUT THE INVENTION

Figure 1:
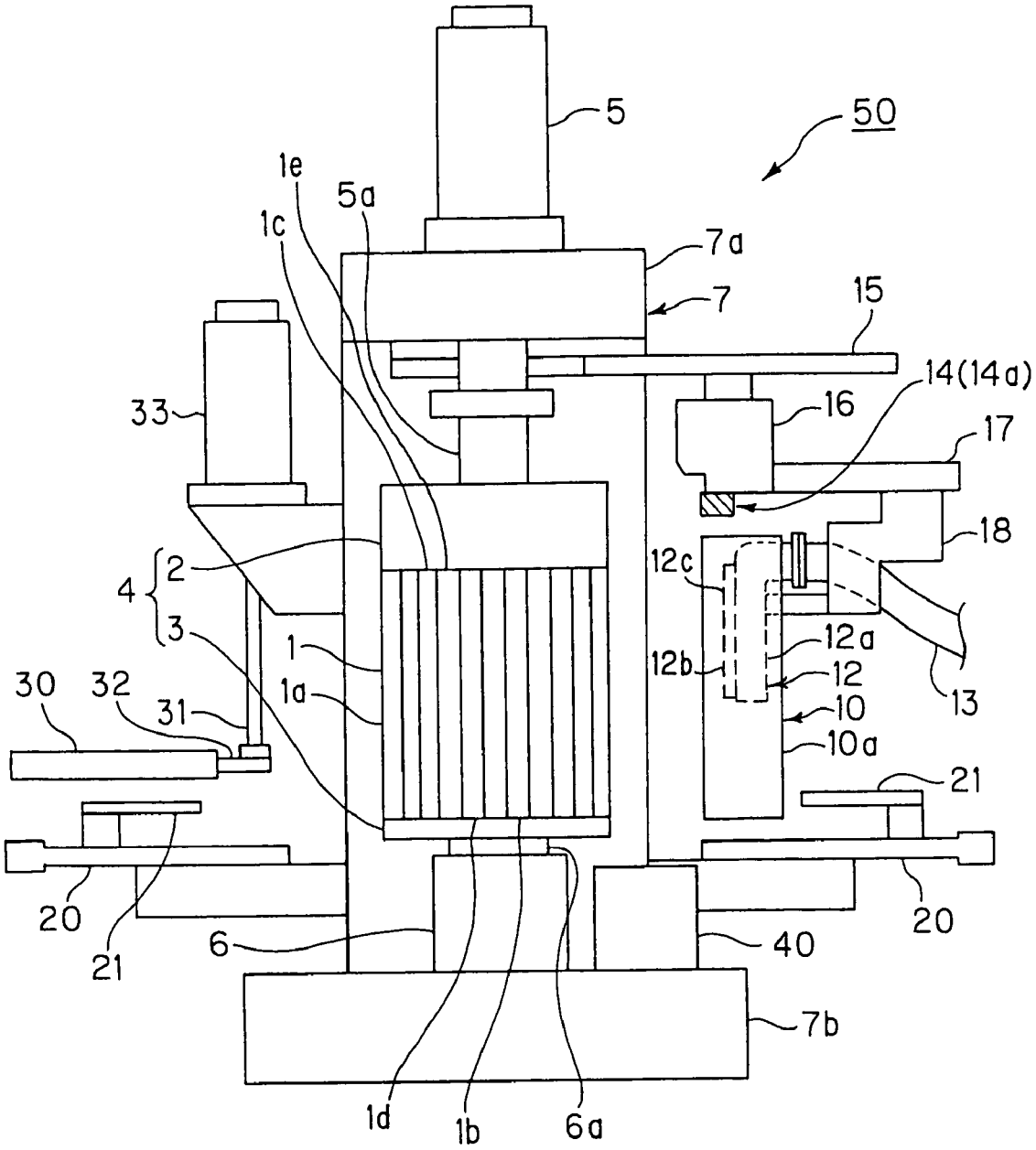
FIG. 1 is a front view which schematically shows one embodiment of the apparatus for coating the outer peripheral surface of a pillar structure according to the present invention.

According to the apparatus for coating the outer peripheral surface of a pillar structure, the supplying and coating means has a nozzle having an opening in the form of a slit and the opening is disposed in nearly vertical direction with the position of the upper end of the opening being nearly the same as the position of the upper end of the pillar structure and has a length in longer direction which is shorter than the length between the both ends of the pillar structure, and the coating material is supplied from the opening of the nozzle to the upper side of the outer peripheral surface of the pillar structure and coated thereon, and simultaneously the coating surface of the coating material supplied and coated is smoothed between the outer peripheral surface and the longer side end portion of the smoothing means, and as a result, it becomes possible to form a uniform coating surface on the whole outer peripheral surface of the pillar structure without causing the coating material scraped by the smoothing plate to flow down along the nozzle (to the lower side of the outer peripheral surface), resulting in thick coating on the lower part of the outer peripheral surface. Thus, the coating portion is inhibited from cracking during drying after coating. Furthermore, the method for coating the outer peripheral surface of a pillar structure according to the present invention comprises coating a coating material on the outer periphery of the pillar structure and smoothing the coating surface using the apparatus for coating the outer peripheral surface of a pillar structure of the present invention, and hence the coating portion is inhibited from cracking during drying after coating.

The embodiments of the present invention will be specifically explained referring to the drawings. It should be understood that the present invention is not limited to the follwing embodiments, and variations or alterations of designs may be optionally made without departing from the spirit of the present invention.

FIG. 1 is a front view which schematically shows one embodiment of the apparatus for coating the outer peripheral surface of a pillar structure according to the present invention.

As shown in FIG. 1, in the apparatus 50 for coating the outer peripheral surface of a pillar structure according to this embodiment, a holding means 4 comprising a pedestal 3 and a cam 2 is fitted at around the central part of a frame 7 in such a manner that it can rotate on an axis of vertical direction as a rotating axis, and a smoothing means 10 and a supplying and coating means 12 are fitted together to a frame top part 7*a* through a back and forth moving base 15, an arm rotating part 16 and arms 17 and 18.

The pedestal 3 constituting the holding means 4 is in the form of a disc and fitted to a frame bottom part 7*b* in such a manner that it is vertically movable and its central axis is in vertical direction. To the pedestal 3 is fitted a pedestal motor 6 through a shaft 6*a*, and the pedestal 3 rotates on the central axis of the pedestal 3 as a rotation center. Furthermore, the cam 2 constituting the holding means 4 is in the form of a thick disc (a cylindrical body low in height) and fitted to the frame top part 7*a* in such a manner that it is vertically movable and its central axis nearly coincides with the central axis of the pedestal 3. To the cam 2 is fitted a cam motor 5 through a shaft 5*a*, and the cam 2 rotates on the central axis of the cam 2 as a rotation center. The rotation of pedestal 3 and that of cam 2 are synchronous. For holding the pillar structure 1 by the holding means 4 having the above construction, the pillar structure 1 is placed on the pedestal 3 with the central axis nearly coinciding with the central axis of the pedestal 3 (with one end 1*b* facing downwardly), and the cam 2 is disposed on the side of another (upper) end 1*c*, thereby to interpose (hold) the pillar structure 1 between the pedestal 3 and the cam 2. The thus held pillar structure 1 can rotate on the central axis as a common rotating axis (common to the central axis of cam 2 and that of the pedestal 3) simultaneously with the synchronous rotation of pedestal 3 and cam 2. Here, the cam 2 and the pedestal 3 are formed so that their outer peripheral shape is nearly the same as that of the pillar structure 1.

Figure 6:
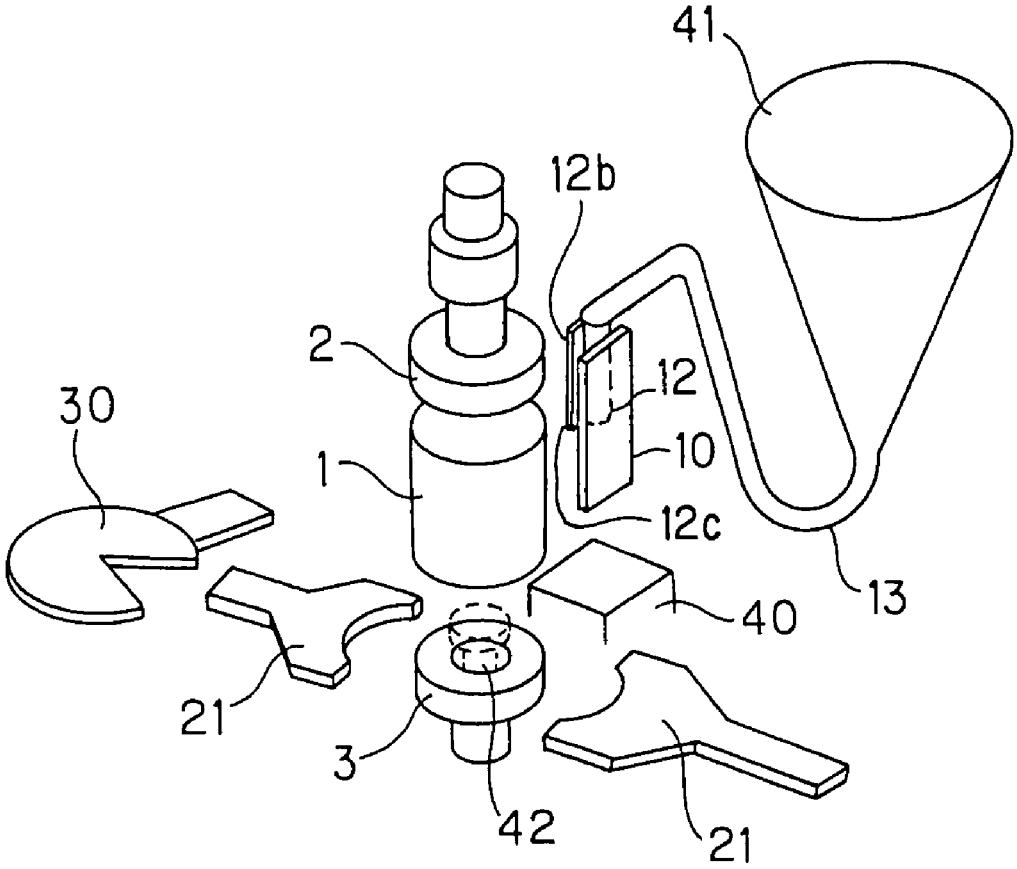
FIG. 6 is an oblique view which schematically shows one embodiment of the apparatus for coating the outer peripheral surface of a pillar structure according to the present invention.

When the pillar structure 1 is to be placed on the pedestal 3, the pillar structure 1 is placed on a transferring pallet 30 shown in FIG. 1 and FIG. 6, and the transferring pallet 30 having the pillar structure 1 placed thereon is moved to the space above the pedestal 3. In this case, the transferring pallet 30 is rotated and moved by a swing motor 33 through a support shaft 31 and swing arm 32. As shown in FIG. 6, an elevatable push-up plate 42 provided at the central portion of the pedestal 3 is elevated to place the pillar structure 1 thereon, and after the transferring pallet 30 moves to the original position, the push-up plate 42 is lowered and stayed on the pedestal 3 (the upper surface of the pedestal 3 and the upper surface of the push-up plate 42 are positioned on the same plane). Thus, the pillar structure 1 is disposed on the pedestal 3, and by the centering plates 21, 21 shown in FIG. 1 and FIG. 6, the pillar structure 1 is positioned so that the central axis thereof nearly coincides with the central axis of cam 2 and that of pedestal 3. As shown in FIG. 1, the two centering plates 21, 21 are disposed on two rails 20, 20 provided on nearly the same straight line. The two centering plates 21, 21 move on the rails 20, 20 to the direction of the central axis of the cam 2 and the pedestal 3 and stop at the positions which are nearly equal in distance between the respective centering plates 21, 21 and the central axis of the cam 2 and that of the pedestal 3 and at the positions at which the distance between the two centering plates 21, 21 is nearly the same as the outer diameter of the pillar structure 1, whereby the central axis of the pillar structure 1 is allowed to nearly coincide with the central axis of the cam 2 and that of the pedestal 3 in such a manner that the pillar structure 1 is interposed by the two opposing centering plates 21, 21. The portion of the centering plate 21 which contacts with the outer peripheral surface 1*a* preferably has a shape conforming with the shape of the outer peripheral surface 1*a*, and, for example, in the case of cylindrical pillar structure, the portion preferably has a shape conforming with a circular arc as shown in FIG. 6.

The upper end of the pillar structure 1 placed on the pedestal 3 contacts with the cam 2 when the pedestal 3 is elevated along a pair of guide rails (not shown) and thus the pillar structure 1 is interposed between the cam 2 and the pedestal 3 (the cam 2 is disposed on the side of upper end of the pillar structure 1). Thus, the pillar structure 1 is in the state of being held by the holding means 4. Here, it is preferred to attach a cushioning sheet such as of rubber or sponge to the opposing faces of the pedestal 3 and the cam 2 (faces contacting with the end faces 1*b* and 1*c* of the pillar structure 1) for preventing breakage of the pillar structure 1.

Figure 2:
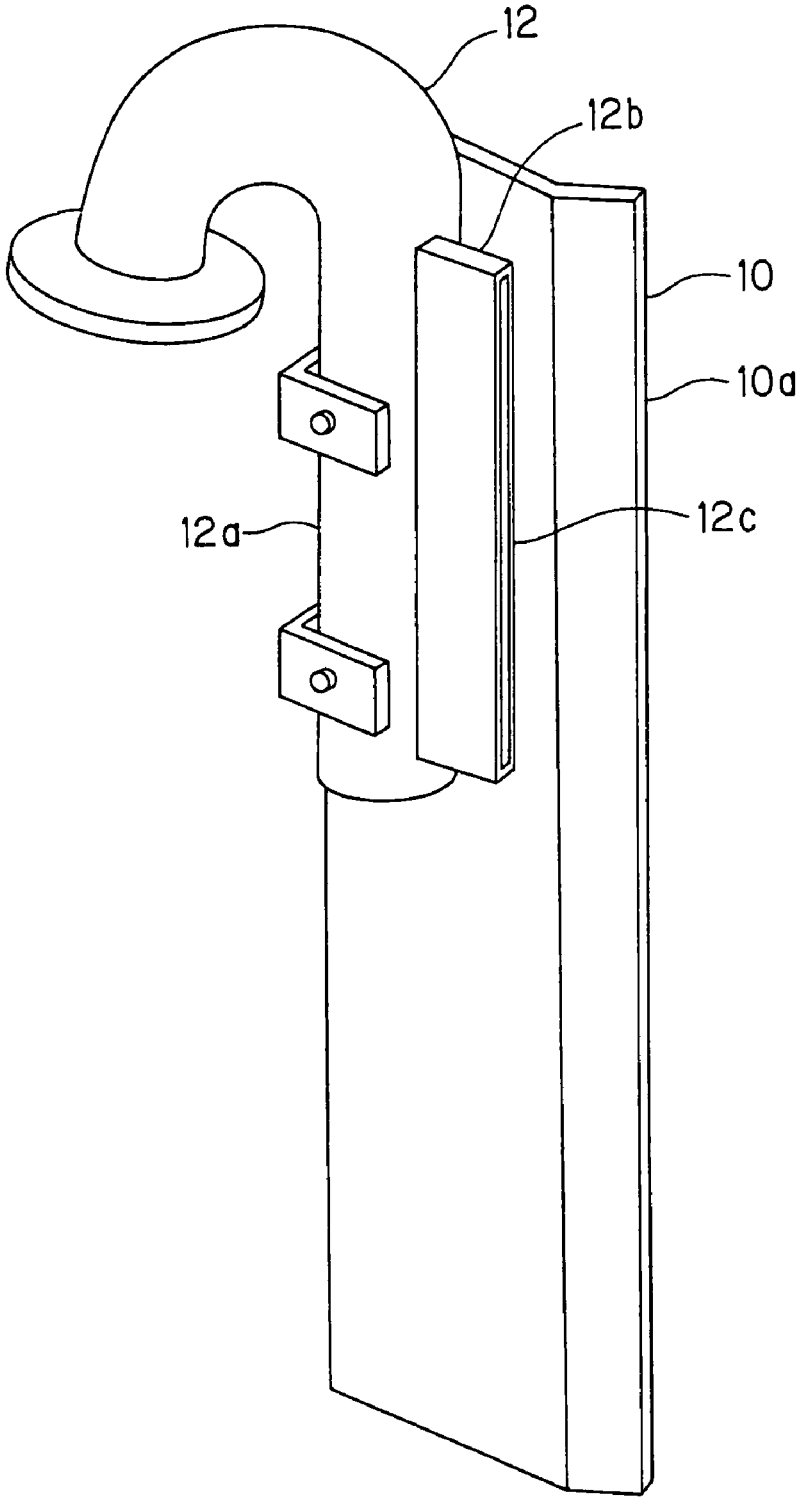
FIG. 2 is an enlarged oblique view which schematically shows a smoothing means and a supplying and coating means used in one embodiment of the apparatus for coating the outer peripheral surface of a pillar structure according to the present invention.

As shown in FIG. 2, in the supplying and coating means 12, a nozzle 12*b* having an opening 12*c* in the form of a slit is formed at a supplying pipe 12*a* in such a manner that the longer direction of the nozzle 12*b* is along the longer direction of the supplying pipe 12*a*, and a slit-shaped hole is formed at the supplying pipe 12*a* so that the hole communicates with the opening 12*c* (space portion) of the nozzle 12*b*. As shown in FIG. 1, the supplying and coating means 12 is disposed in nearly vertical direction and in such a manner that the position of the upper end of the opening 12*c* of the nozzle 12*b* is nearly the same as the position of the upper end 1*e* of the pillar structure 1 (the nearly same height in vertical direction). Furthermore, the opening 12*c* of the nozzle 12*b* has a length in longer direction which is shorter than the length between the both ends of the pillar structure 1. The length of the opening 12*c* of the nozzle 12*b* in longer direction is preferably 30-80% of the length between the both ends of the pillar structure 1. If the length is less than 30%, the length in longer direction becomes short, and hence it becomes difficult to form a uniform coating surface of the coating material on the whole outer peripheral surface 1*a* of the pillar structure 1. If it is more than 80%, since the length in longer direction becomes long, the coating material stays on the lower side of the nozzle 12*b* and is deposited on the outer peripheral surface 1*a*, sometimes causing a thick coating on the lower side of the outer peripheral surface 1*a*.

The supplying and coating means 12 is disposed so that the opening 12*c* of the nozzle 12*b* faces the side of the pillar structure 1 and the central axis of the supplying pipe 12*a* (the longer direction of the nozzle 12*b*) is in the direction of the central axis of the pillar structure 1. The piping 13 is connected to the upper end portion of the supplying pipe 12*a*, and the coating material supplied through the piping 13 is supplied to the outer peripheral surface 1*a* of the pillar structure 1 from the opening 12*c* of the nozzle 12*b* through the supplying pipe 12*a* and coated on the outer peripheral surface 1*a*.

As shown in FIG. 1, the smoothing means 10 is provided so that its longer direction coincides with the central axis of the pillar structure 1. The smoothing means 10 includes a smoothing plate 10*a* and the smoothing plate 10*a* is a rectangular plate as shown in FIG. 1. The distance between the smoothing plate 10*a* and the outer peripheral surface 1*a* of the pillar structure 1 can be adjusted so as to form a desired coating on the outer peripheral surface, and the distance is preferably 2.0 mm or less and can be such that the smoothing plate 10*a* contacts with the outer peripheral surface 1*a* of the pillar structure 1. If the distance is more than 2.0 mm, this exceeds the thickness of a uniform coat which can be formed of the coating material, and hence the coat cannot sometimes be smoothed by the smoothing plate 10*a*.

As shown in FIG. 2, the supplying and coating means 12 and the smoothing means 10 are formed integrally in such a manner that the direction of the nozzle 12*b* of the supplying and coating means 12 is in the direction of one loner side end portion of the smoothing means 10. The supplying and coating means 12 and the smoothing means 10 which are integral are disposed so that the opening 12*c* of the nozzle 12*b* faces the side of the pillar structure 1 and they are along the outer peripheral surface 1*a*.

As shown in FIG. 1, a nearly cylindrical following roller 14 as a following means is provided at the bottom of the arm rotating part 16 and is formed in such a manner that it moves in nearly horizontal direction together with the supplying and coating means 12 and the smoothing means 10 through the arms 17 and 18 and the arm rotating part 16. The horizontal movement is carried out by nearly horizontal slide movement of the back and forth moving base 15 to which the arm rotating part 16 is fitted. The following roller 14 is formed in such a manner that when it contacts with the cam 2, it freely rotates by the force of rotation of the cam 2 while contacting with the cam 2 on the axis of a vertical direction as a rotating center.

Figure 3:
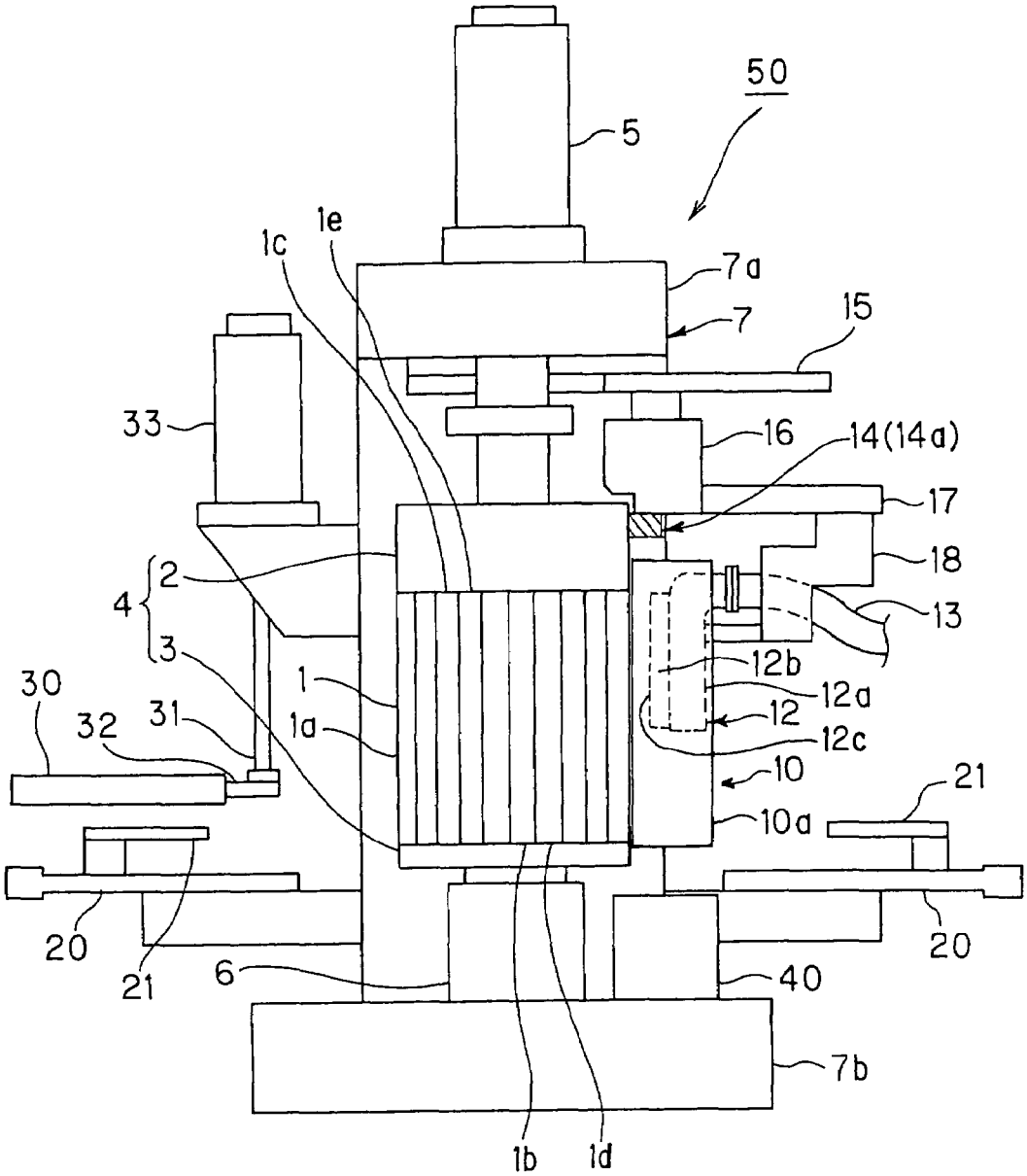
FIG. 3 is a front view which shows one embodiment of the apparatus for coating the outer peripheral surface of a pillar structure according to the present invention and schematically shows a state in which the supplying and coating means and others are moved to the side of the pillar structure.

FIG. 3 shows the state in which the following roller 14 contacts with the outer peripheral surface of the cam 2 and the smoothing plate 10*a* of the smoothing means 10 is disposed at a given distance from the outer peripheral surface 1*a* of the pillar structure 1. This state shows the state of FIG. 1 in which the supplying and coating means 12, the smoothing means 10, the following roller 14 and the back and forth moving base 15 which move together are moved to the side of the pillar structure 1 by the slide movement of the back and force moving base 15 for carrying out the coating of the outer peripheral surface 1*a*. Since this movement is a horizontal movement, the longer direction of the supplying pipe 12*a* (and nozzle 12*b*) of the supplying and coating means 12, the longer direction of the smoothing means 10 (smoothing plate 10*a*) and the rotating axis of the roller 14 all maintain the state of being nearly parallel (vertical direction) with the central axis of the pillar structure 1.

Figure 4:
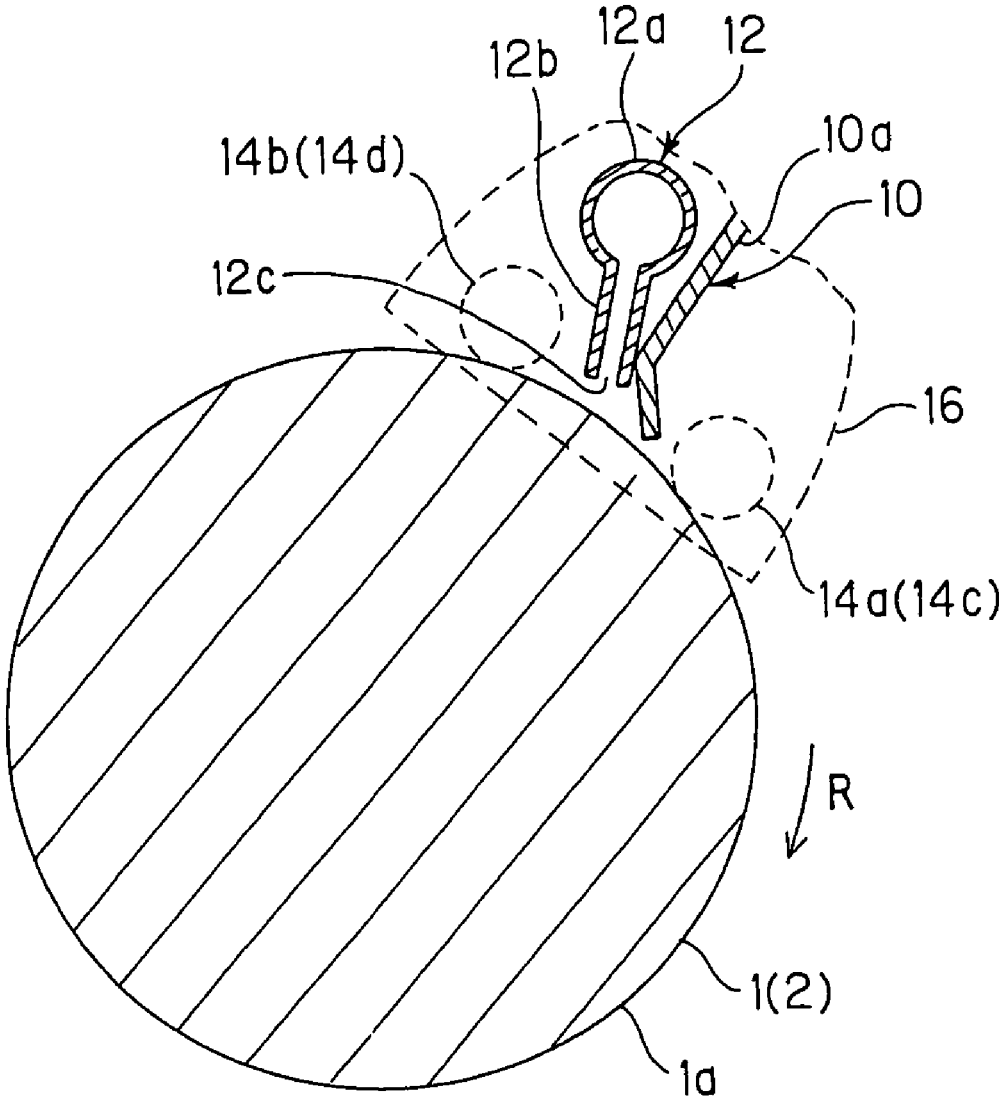
FIG. 4 is a sectional view which shows mutual positional relation of a smoothing means, a supplying and coating means and a following means used in one embodiment of the apparatus for coating the outer peripheral surface of a pillar structure according to the present invention.

As shown in FIG. 3, the smoothing plate 10*a* constituting the smoothing means 10 is provided at a given distance from the outer peripheral surface 1*a* of the pillar structure 1 between both ends 1*b* and 1*c* of the pillar structure 1, and as shown in FIG. 4, the nozzle 12*b* of the supplying and coating means 12 is disposed at a given distance from the outer peripheral surface 1*a* of the pillar structure 1 with the opening 12*c* of the nozzle 12*b* of supplying and coating means 12 being directed toward the pillar structure 1. The coating material supplied through the piping 13 (see FIG. 3) is supplied to the upper part of the outer peripheral surface 1*a* of the rotating pillar structure 1 from the nozzle 12*b* and coated thereon, and immediately thereafter the coating surface of the coating material is smoothed (smoothed by the smoothing plate 10*a*) between the smoothing means 10 (smoothing plate 10*a*) and the outer peripheral surface 1*a* to form a uniform coating surface on the whole outer peripheral surface 1*a* of the pillar structure 1.

As mentioned above, the opening 12*c* of the supplying and coating means 12*b* is disposed so that the position of the upper end portion of the opening 12*c* is nearly the same as the position of the upper end portion 1*e* of the pillar structure 1, and the length of the opening 12*c* in the longer direction is shorter than the length between the both ends of the pillar structure 1, and therefore the coating material supplied to the upper side of the outer peripheral surface 1*a* does not flow downwardly along the smoothing plate 10*a* and a uniform coating surface can be formed on the whole outer peripheral surface 1*a* of the pillar structure 1. Thus, the coating portion can be inhibited from cracking at the time of drying after coating.

In this embodiment, as shown in FIG. 4, the following roller 14 used as the following means for moving the supplying and coating means 12 and the smoothing means 10 following the outer peripheral shape of the pillar structure 1 comprises a first following roller 14*a* and a second following roller 14*b*, which are positioned on nearly the same horizontal plane. The two following rollers 14 (the first following roller 14*a* and the second following roller 14*b*) are allowed to move in parallel in a certain direction following the outer peripheral shape of the pillar structure 1 upon rotation of the pillar structure 1 while being slightly pressed against the outer peripheral surface of the cam 2 by the force of spring (not shown). When these two following rollers 14 (the first following roller 14*a* and the second following roller 14*b*) move following the outer peripheral shape of the cam 2, since the following rollers 14 move together with the supplying and coating means 12 and the smoothing means 10, the distance between the supplying and coating means 12 and the smoothing means 10 and the outer peripheral surface 1*a* of the pillar structure 1 can be kept constant. In this case, it is preferred that the outer diameter of the pillar structure 1 is smaller than the outer diameter of the cam 2 and that of the pedestal 3 by the thickness of the coating to be applied onto the pillar structure 1. By this difference in diameter, the thickness of the coating portion on the outer peripheral surface 1*a* of the pillar structure 1 can be adjusted. Furthermore, when the sectional shape of the pillar structure 1 cut along a plane perpendicular to the central axis of the pillar structure 1 is circle, the interval between the central axis of the first following roller 14*a* and that of the second following roller 14*b* is preferably 10-170% of a radius of the circle, and when the sectional shape is other than circle, which is "a shape (such as ellipse) having a perimeter of smooth curve (which may include a straight line)", the interval is 10-170% of the smallest radius of curvature. If the interval is less than 10%, since the movement of the following rollers 14 is not stable, the direction (angle) of the supplying and coating means 12 and the smoothing means 10 to the outer peripheral surface 1*a* changes, and, hence, stable coating is sometimes hindered. If it is more than 170%, since the position of the following means 14 is remote from the supplying and coating means 12 and the smoothing means 10 at the position projected on a horizontal plane, unevenness of the portion at which the following means 14 contacts with the outer peripheral surface 1*a* sometimes differs from that of the portion at which the smoothing means 10 contacts with the outer peripheral surface 1*a*.

In order to move the supplying and coating means 12 and the smoothing means 10 more stably by the following rollers 14, a third following roller 14*c* and a fourth following roller 14*d* which move together with the first following roller 14*a* and the second following roller 14*b* may be provided in such a manner that they copy the outer peripheral surface of the pedestal 3. In this case, it is preferred for stable moving that the rotating axis of the third following roller 14*c* and that of the first following roller 14*a* are common and the rotating axis of the fourth following roller 14*d* and that of the second following roller 14*b* are common.

Figure 5:
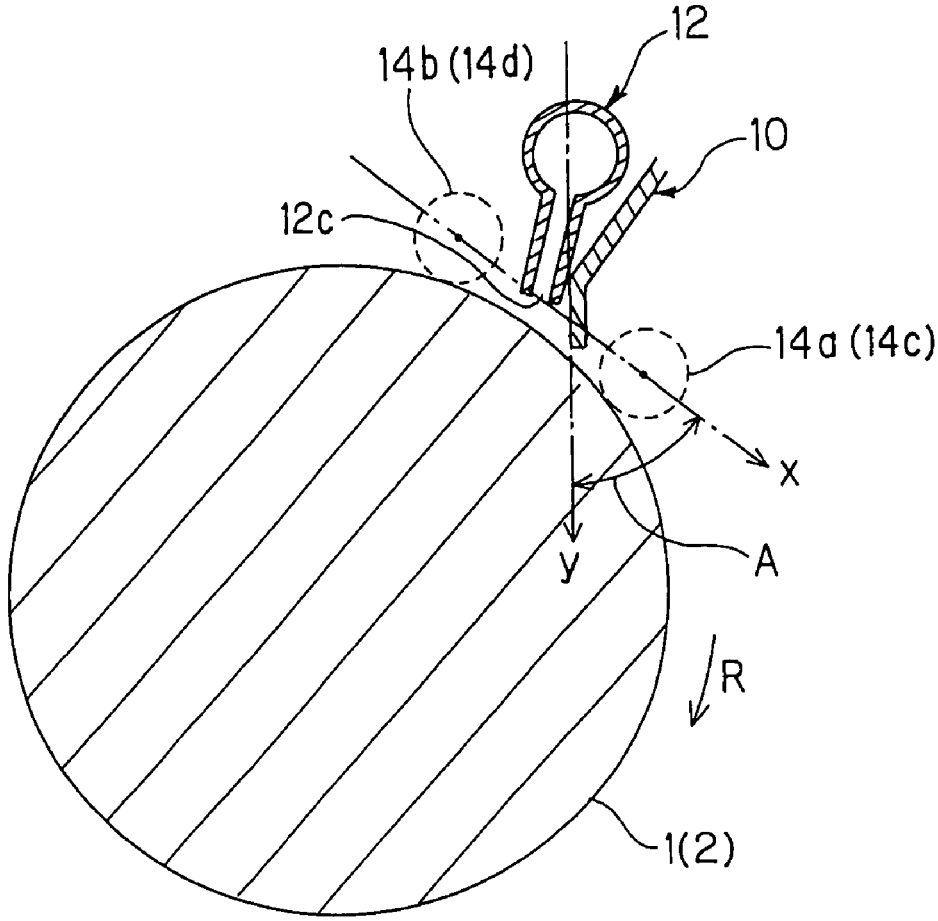
FIG. 5 is a sectional view which shows mutual positional relation of a smoothing means, a supplying and coating means and a following means used in one embodiment of the apparatus for coating the outer peripheral surface of a pillar structure according to the present invention.

It is preferred that as shown in FIG. 5, angle A formed by a straight line passing the center of the following roller 14*a* and that of the following roller 14*b* and the tip portion of the smoothing means 10 is 20-60°. If the angle A is smaller than 20°, the force to remove excess coating material becomes smaller and the coating may become larger than the desired size, and if it is greater than 60°, the outer peripheral surface of the pillar structure is strongly pressed and the coating material may be scraped in an amount more than needed. Here, the angle A is an angle formed by "direction x" of a straight line passing the center of the following roller 14*a* and that of the following roller 14*b* which directs to the rotation direction R of the pillar structure 1 and "direction y" which is an extension line extending from the tip portion of the smoothing means 10 to the pillar structure 1.

The material of the cam 2, pedestal 3 and smoothing plate 10 is not particularly limited, and it is preferred that the outer surface thereof is formed of stainless steel or wear-resistant ceramics. The wear-resistant ceramics are preferably $Si_3N_4$, PZT, SiC or $Al_2O_3$.

The apparatus 50 for coating the outer peripheral surface of a pillar structure of this embodiment (see FIG. 1) can be applied preferably to coating of the outer peripheral surface of the pillar structure 1 the section of which cut along a plane perpendicular to the central axis is circle or ellipse, and moreover it can also be preferably applied to coating of the pillar structure having the shape of section other than circle or ellipse and having an outer peripheral surface comprising a smooth curved surface.

The apparatus 50 for coating the outer peripheral surface of a pillar structure of this embodiment (see FIG. 1) can be preferably applied to coating of the pillar structure 1 which is a honeycomb structure comprising a plurality of cells which serve as flow paths of fluid. Suitable examples of the material of the honeycomb structure are ceramics.

The coating materials employed in using the apparatus for coating the outer peripheral surface of a pillar structure of this embodiment are not particularly limited so long as they are suitable for coating the outer peripheral surface of the pillar structure, and there may be used, for example, paste-like coating materials containing inorganic fibers, inorganic binders, inorganic particles, organic binders, or the like. The inorganic fibers include, for example, ceramic fibers such as silica alumina, mullite, alumina and silica. The inorganic binders include, for example, silica sol, alumina sol and the like. The inorganic particles include, for example, powdered silicon carbide, powdered silicon nitride, powdered boron nitride, and whiskers. The organic binders include, for example, polyvinyl alcohol, methylcellulose, ethylcellulose and carboxycellulose. Furthermore, the coating materials contain solvents such as water, acetone and alcohol, in addition to the inorganic fibers, inorganic binders, inorganic particles, organic binders, etc. The viscosity of the paste-like coating materials is adjusted by these solvents to give the state suitable for coating on the outer peripheral surface of the pillar structure. The viscosity of the coating material is preferably 15-50 Pa·s. If the viscosity is lower than 15 Pa·s, the thickness of the coating sometimes becomes too thin because of the low viscosity, and if it is higher than 50 Pa·s, it becomes difficult to perform thin and uniform coating on the outer peripheral surface because of the high viscosity.

In another embodiment of the apparatus for coating the outer peripheral surface of a pillar structure according to the present invention, the holding means 4 has the pedestal 3, but does not have the cam 2. The pillar structure 1 is placed on the pedestal 3 in such a manner that its central axis nearly coincides with the central axis of the pedestal 3, the smoothing plate 10*a* of the smoothing means 10 is disposed at a given distance from the outer peripheral surface 1*a* of the pillar structure 1, and the coating surface of the coating material supplied from the nozzle 12*b* of the supplying and coating means 12 and coated on the outer peripheral surface 1*a* of the pillar structure 1 is smoothed by the smoothing plate 10*a* between the outer peripheral surface 1*a* and the smoothing means 10 (the smoothing plate 10*a*). In this case, the following rollers 14 used as a following means are two rollers of the third following roller 14*c* and the fourth following roller 14*d* which copy the outer periphery of the pedestal 3 since the holding means 4 does not have the cam 2.

This embodiment is the same as the embodiment shown in FIG. 1, except that the holding means 4 has the pedestal 3, but does not have the cam 2 and the following means 14 comprises the two rollers of the third following roller 14*c* and the fourth following roller 14*d* which copy the outer periphery of the pedestal 3.

In further another embodiment of the apparatus for coating the outer peripheral surface of a pillar structure according to the present invention, the supplying and coating means 12 and the smoothing means 10 rotate together along the outer peripheral surface 1*a* of the pillar structure 1. In this case, while the supplying and coating means 12, the smoothing means 10 and the following means 14 rotate together along the outer peripheral surface 1*a* of the pillar structure 1 on the central axis of the pillar structure 1 as a rotation center, the coating material is supplied from the supplying and coating means 12 and coated on the surface, and the coating surface is smoothed by the smoothing means 10.

This embodiment is the same as the embodiment shown in FIG. 1, except that the supplying and coating means 12, the smoothing means 10 and the following means 14 rotate together along the outer peripheral surface 1*a* of the pillar structure 1 as a rotation center.

Next, the method for coating the outer peripheral surface of a pillar structure according to the present invention will be explained specifically referring to the drawings. The method for coating the outer peripheral surface of a pillar structure according to the present invention is characterized in that using the apparatus 50 for coating the outer peripheral surface of a pillar structure described above (see FIG. 1), the pillar structure 1 is held by the holding means 4, and while rotating the pillar structure 1 on an axis of nearly vertical direction as a common rotating axis, a coating material is supplied from the supplying and coating means 12 onto the outer peripheral surface 1*a* of the pillar structure 1 and is coated on the outer peripheral surface 1*a*, and the coating surface of the supplied and coated coating material is smoothed by the smoothing plate 10*a* between the outer peripheral surface 1*a* and the smoothing means 10 (smoothing plate 10*a*).

In this embodiment, first, the pillar structure 1 is placed on the transferring pallet 30 shown in FIG. 1 and FIG. 6, and the transferring pallet 30 is moved to the space above the pedestal 3. Thereafter, the push-up plate 42 which can elevate and is provided at the central portion of the pedestal 3 (see FIG. 6) is elevated to place the pillar structure 1 thereon, and after the transferring pallet 30 is moved to the original position, the push-up plate 42 is lowered and allowed to stay in the pedestal 3 (namely, the upper surface of the pedestal 3 and the upper surface of the push-up plate 42 are disposed on the same plane), thereby disposing the pillar structure 1 on the pedestal 3, and by using the centering plates 21, 21 shown in FIG. 1 and FIG. 6, the pillar structure 1 is positioned so that the central axis thereof nearly coincides with the central axis of the cam 2 and that of the pedestal 3.

The upper end 1*c* of the pillar structure 1 placed on the pedestal 3 is allowed to contact with the cam 2 by elevating the pedestal 3, and thus the pillar structure 1 is interposed between the cam 2 and the pedestal 3 (the cam 2 is positioned on the upper end side of the pillar structure 1). Thus, the pillar structure 1 is in the state of being held by the holding means 4.

Next, a slurry-like coating material is fed to a tank 41 shown in FIG. 6. The supplying and coating means 12, the smoothing means 10 and the following means 14 are moved so that the distance between the smoothing plate 10*a* of the smoothing means 10 and the outer peripheral surface 1*a* of the pillar structure 1 is a given distance and the following means 14 contacts with the outer peripheral surface of the cam 2 as shown in FIG. 3 (namely, to transfer the state of FIG. 1 to the state of FIG. 3). In this case, the upper end portion of the smoothing plate 10*a* is positioned above the upper end portion 1*e* of the pillar structure 1 and the lower end portion of the smoothing plate 10*a* is positioned below the lower end portion 1*d* of the pillar structure 1. Then, a motor 5 for the cam and a motor 6 for the pedestal are started to rotate the cam 2, the pedestal 3 and the pillar structure 1 at a given number of rotation. In this state, the coating material is sent to a supply pipe 12*a* through a piping 13 by a coating material supplying pump (not shown) and is supplied to the upper side of the outer peripheral surface 1*a* of the pillar structure 1 from the opening 12*c* of the nozzle 12*b* and coated on the outer peripheral surface 1*a*. The coating material which is coated on the upper side of the outer peripheral surface 1*a* of the pillar structure 1 and which is moving downward by gravity is smoothed by the smoothing plate 10*a* of the smoothing means 10 to complete formation of a coating having a uniform coating surface on the whole outer peripheral surface 1*a* of the pillar structure 1.

After completion of the coating of the outer peripheral surface 1*a* of the pillar structure 1, rotation of the cam 2 and the pedestal 3 is stopped and the pedestal 3 is lowered. Thereafter, the pillar structure 1 is pushed up by the push-up plate 42 (see FIG. 6) to raise the end face 1*b* of the pillar structure 1 and the transferring pallet 30 is moved to the lower part of the end face 1*b*. Then, the push-up plate 42 is lowered and the pillar structure 1 is put on the transferring pallet 30 and transferred onto a drying machine stand (not shown), at which the coating material which has been supplied by the supplying and coating means 12 and now has become surplus is recovered by a slurry receiver 40 provided below the smoothing means 10 and recovered into the tank 41 (see FIG. 6) by a pump (not shown).

As mentioned above, the outer peripheral surface 1*a* of the pillar structure 1 is coated using the apparatus for coating the outer peripheral surface of a pillar structure according to the present invention, in which the opening 12*c* of the nozzle 12 of the supplying and coating means 12 is disposed so that the position of the upper end of the opening 12*c* is nearly the same as the position of the upper end 1*e* of the pillar structure 1 and is formed so that the length in longer direction of the opening 12*c* is shorter than the length between the both ends of the pillar structure 1. Therefore, the coating material supplied to the upper side of the outer peripheral surface 1*a* of the pillar structure does not flow downward along the smoothing plate 10*a* and hence the coating on the lower side of the outer peripheral surface 1*a* does not become thick. Thus, it becomes possible to form a uniform coating surface on the whole outer peripheral surface 1*a* of the pillar structure 1. As a result, the coating portion is inhibited from cracking during drying after coating.

EXAMPLE

The present invention will be explained more specifically by the following examples, which should not be construed as limiting the invention in any manner.

The outer peripheral surface of a pillar structure was coated as shown below using the apparatus for coating the outer peripheral surface of a pillar structure shown in FIG. 1.

(Pillar Structure and Coating Material)

The pillar structure used was a cylindrical honeycomb structure comprising a plurality of cells which serve as flow paths for fluid, and the tests were conducted using two kinds of honeycomb structures of 250 mm and 300 mm in height in the direction of central axis. The material of the two honeycomb structures was cordierite, and the outer peripheral surface was subjected to grinding to obtain the honeycomb structures having an outer diameter of 143 mm, a rib thickness of 0.175 mm and a cell density of 400 cells/(inch)$^2$. The diameter of a section (diameter of circle) perpendicular to the central axis of the cam 2 and the pedestal 3 was nearly the same as the diameter of a section (diameter of circle) perpendicular to the central axis of the honeycomb structure.

The slurry-like coating material used comprised 75% by mass of a coating cement ($SiO_2$: 60.0, $Al_2O_3$: 39.2, $Na_2O$: 0.4, MgO: 0.3 and other inorganic materials: 0.1 with an antifreeze) and 25% by mass of cordierite powder (average particle diameter 2 μm) and had a viscosity of 20-37 Pa·s.

(Method of Coating on Outer Peripheral Surface of Pillar Structure)

The pillar structure (honeycomb structure) 1 was placed on the transferring pallet 30 shown in FIG. 1 and the transferring pallet 30 was moved to the space above the pedestal 3. Thereafter, the push-up plate 42 which can be elevated and was provided at the central portion of the pedestal 3 (see FIG. 6) was elevated to place thereon the pillar structure (honeycomb structure) 1, and after the transferring pallet 30 was moved to the original position, the push-up plate 42 was lowered to dispose the pillar structure (honeycomb structure) 1 on the pedestal 3. By using the centering plates 21, 21 shown in FIG. 1, the pillar structure (honeycomb structure) 1 was positioned so that the central axis thereof nearly coincided with the central axis of cam 2 and that of pedestal 3.

The upper end of the pillar structure (honeycomb structure) 1 placed on the pedestal 3 was allowed to contact with the cam 2 by elevating the pedestal 3, and the pillar structure (honeycomb structure) 1 was interposed between the cam 2 and the pedestal 3. Thus, the pillar structure (honeycomb structure) 1 was in the state of being held by the holding means 4.

Next, a slurry-like coating material was fed to the tank 41 shown in FIG. 6. The supplying and coating means 12, the smoothing means 10 and the following means 14 were moved so that the smoothing plate 10*a* of the smoothing means 10 was positioned along the outer peripheral surface 1*a* of the pillar structure (honeycomb structure) 1 and the following means 14 contacted with the outer peripheral surface of the cam 2 as shown in FIG. 3 (namely, transferring the state of FIG. 1 to the state of FIG. 3). In this case, the distance between the end portion of the smoothing plate 10*a* on the side of the pillar structure (honeycomb structure) 1 and the outer peripheral surface 1*a* of the pillar structure (honeycomb structure) 1 was 0.5 mm. Furthermore, the angle A (formed by a straight line passing the center of the following roller 14*a* and that the following roller 14*b* (direction x) and an extension line of the tip portion of the smoothing means 10 (smoothing plate 10*a*) (direction y)) shown in FIG. 5 was 45°. In this state, the coating material was sent to the supply pipe 12*a* through the piping 13 by a coating material supplying pump (not shown) and was supplied to the upper side of the outer peripheral surface 1*a* of the pillar structure (honeycomb structure) 1 from the opening 12*c* of the nozzle 12*b* and coated on the outer peripheral surface 1*a*. The coating surface of the coating material coated on the outer peripheral surface 1*a* of the pillar structure (honeycomb structure) 1 was smoothed by the smoothing plate 10*a* of the smoothing means 10 to complete the coating of the outer peripheral surface 1*a* of the pillar structure (honeycomb structure) 1. In this case, the cam 2 and the pedestal 3 were rotated (on their own axis) three times at the number of rotation of 10 rpm during the supplying and coating, and, thereafter, rotated (on their own axis) one time at 10 rpm. The material of the smoothing plate 10*a*was stainless steel, and the smoothing plate 10*a* had an elastic body (rubber) at its tip.

(Evaluation on Evenness of Coating and on Cracking at Drying)

In the above-mentioned method of coating on the outer peripheral surface of the pillar structure, evaluation was conducted on evenness of coating or occurrence of cracking at drying in the pillar structures (honeycomb structures) 1 having a height (length of product) in the central axis direction of 250 mm with varying the length of the nozzle in longer direction (nozzle length), namely, 120, 170 and 220 mm (Examples 1-3) and in the pillar structures (honeycomb structures) 1 having a height (length of product) in the central axis direction of 300 mm with varying the length of the nozzle in longer direction, namely, 120, 170, 220, 270 and 320 mm (Examples 4-7 and Comparative Example 1). The evenness of coating and the occurrence of cracking at drying were visually examined, and when there were no uneven coating or there occurred no cracking at drying, this is indicated by "○"; when the proportion of uneven coating or cracking at drying was 0-50%, this is indicated by "Δ"; and when the proportion of uneven coating or cracking at drying was more than 50%, this is indicated by "×". Here, the term "uneven coating" means the portion where the coating thickness of the coating material was thicker according to visual inspection, and the term "cracking at drying" means the portion where cracks occurred during drying. The term "proportion of uneven coating or cracking at drying" means the ratio of area of the portion where uneven coating or cracking at drying occurred to the whole area of the outer peripheral surface of the honeycomb structure. The length of product, the length of nozzle, the ratio of length of nozzle to length of product (length of nozzle/length of product), and the results of evaluation are shown in Table 1.

TABLE 1

| | Length of product | Length of nozzle | Length of nozzle/Length of product (%) | Results of evaluation |
|---|---|---|---|---|
| Example 1 | 250 | 220 | 88 | Δ |
| Example 2 | 250 | 170 | 68 | ○ |
| Example 3 | 250 | 120 | 48 | ○ |
| Example 4 | 300 | 270 | 90 | Δ |
| Example 5 | 300 | 220 | 73 | ○ |

TABLE 1-continued

| | Length of product | Length of nozzle | Length of nozzle/Length of product (%) | Results of evaluation |
|---|---|---|---|---|
| Example 6 | 300 | 170 | 57 | ○ |
| Example 7 | 300 | 120 | 40 | ○ |
| Comparative Example 1 | 300 | 320 | 107 | X |

Length of product: Height of honeycomb structure in the direction of central axis (unit: mm)

Length of nozzle: Length of nozzle in longer direction (unit: mm)

Length of nozzle/length of product: The ratio of length of nozzle to length of product (length of nozzle/length of product×100)

It can be seen from Table 1 that pillar structures in which the ratio of the length of nozzle in longer direction to the distance between both end faces of the pillar structure was smaller showed less uneven coating or cracking at drying.

INDUSTRIAL APPLICABILITY

As explained above, according to the apparatus for coating the outer peripheral surface of a pillar structure of the present invention, the supplying and coating means has a nozzle having an opening in the form of a slit and the opening is disposed in nearly vertical direction with the position of the upper end of the opening being nearly the same as the position of the upper end of the pillar structure and has a length in longer direction which is shorter than the length between the both ends of the pillar structure, and the coating material is supplied from the opening of the nozzle to the upper side of the outer peripheral surface of the pillar structure and coated thereon, and simultaneously the coating surface of the coating material supplied and coated is smoothed by the smoothing means between the outer peripheral surface and the longer side end portion of the smoothing means, and, as a result, it becomes possible to form a uniform coating surface on the whole outer peripheral surface of the pillar structure without causing the coating material scraped by the smoothing plate to flow down along the nozzle (to the lower side of the outer peripheral surface) and to stay at the lower side of the nozzle, resulting in thick coating on the lower part of the outer peripheral surface. Thus, the coating portion is inhibited from cracking during drying after coating to form a coating on the outer peripheral surface free from defects. Furthermore, the method for coating the outer peripheral surface of a pillar structure according to the present invention comprises coating a coating material on the outer periphery of the pillar structure and smoothing the coating surface using the apparatus for coating the outer peripheral surface of a pillar structure of the present invention, and hence the coating portion is inhibited from cracking during drying after coating to form a coating on the outer peripheral surface free from defects.

The invention claimed is:

1. A method for coating an outer peripheral surface of a pillar structure using a coating apparatus, the method comprising:

holding the pillar structure by a holding means of the coating apparatus, the holding means configured to hold the pillar structure in a nearly vertical direction and to rotate together with the held pillar structure on an axis of a substantially vertical direction as a common rotating axis;

supplying and coating the outer peripheral surface of the pillar structure with a coating material from a supplying and coating means of the coating apparatus disposed at a given position with respect to the outer peripheral surface of the pillar structure, wherein:

the supplying and coating means comprises a nozzle having an opening in the form of a slit disposed in a substantially vertical direction, an upper end of the opening being positioned substantially the same as the position of an upper end of the pillar structure, the opening having a length in a longer direction that is 30-80% of the length between the upper end and a lower end of the pillar structure, and the coating material is supplied from the opening of the nozzle to an upper side of the outer peripheral surface of the pillar structure and coated thereon while rotating the pillar structure and the holding means on the axis of substantially vertical direction as a common rotating axis; and smoothing with a smoothing means of the coating apparatus a coating surface of the supplied and coated coating material between an upper side and a lower side of the outer peripheral surface and a longer side end portion of the smoothing means, the smoothing means having a length in a longer direction that is not shorter than the length between the upper and lower ends of the pillar structure and is disposed in a substantially vertical direction in a position to keep a given distance from the outer peripheral surface or from contacting the outer peripheral surface;

wherein a uniform coating surface is formed on a whole outer peripheral surface of the pillar structure.

2. The method according to claim 1, wherein the holding means has a pedestal which holds the pillar structure in the vertical direction, the pillar structure being placed on the pedestal with one end of the pillar structure facing downward.

3. The method according to claim 2, wherein the holding means has a cam which presses downwardly the other end of the pillar structure held on the pedestal and rotates on the axis of the substantially vertical direction as a common rotating axis.

4. The method according to claim 3, wherein the outer peripheral shape of the pedestal and that of the cam are substantially the same.

5. The method according to claim 2, wherein the apparatus further comprises a centering means which holds the pillar structure and the pedestal and/or a cam in a given positional relation.

6. The method according to claim 2, wherein the apparatus further comprises a following means which drives the smoothing means following the outer periphery of the pedestal and/or a cam so that the smoothing means is disposed at a given position with respect to the outer peripheral surface of the pillar structure.

7. The method according to claim 6, wherein the following means has a first and a second following rollers which are disposed at a given distance from each other and move backward and forward following the outer periphery of the cam while contacting the outer periphery of the cam together with the supplying and coating means and the smoothing means, and the first and second following rollers are disposed so that an angle formed by a line passing through the centers of the respective rollers and the smoothing means is a given angle.

8. The method according to claim 7, wherein the following means further has a third and a fourth following rollers which move backward and forward following the outer periphery of the pedestal while contacting the outer periphery of the pedestal together with the supplying and coating means and the smoothing means, and a rotating axis of the third following roller and a rotating axis of the first following roller are common and a rotating axis of the fourth following roller and a rotating axis of the second following roller are common.

9. The method according to claim 2, wherein the outer periphery of the pedestal and/or the cam comprise stainless steel or ceramics.

10. The method according to claim 1 wherein the smoothing means comprises stainless steel or wear-resistant ceramics.

11. The method according claim 1, wherein the shape of a section of the pillar structure cut along a plane perpendicular to the direction of the central axis of the pillar structure is circular or elliptical.

12. The method according to claim 1, wherein the pillar structure is a honeycomb structure comprising a plurality of cells which serve as flow paths for fluid.

13. The method according to claim 1, wherein the supplying and coating means and the smoothing means rotate together along the outer periphery of the pillar structure.

* * * * *